US005309682A

United States Patent [19]

Gutknecht et al.

[11] Patent Number: 5,309,682

[45] Date of Patent: May 10, 1994

[54] HAND HELD POWER TOOL WITH WORKING DISC

[75] Inventors: Arnulf Gutknecht, Filderstadt; Guenther Berger, Notzingen; Manfred-Otto Staebler, Waldenbuch-Glashütte; Manfred-Wilhelm Staebler, Leinfelden-Echterdingen; Claus Kemmner, Aichtal-Neuenhaus; Albert Kleider, Schwaebisch Hall; Martin Schmideder, Leinfelden-Echterdingen, all of Fed. Rep. of Germany

[73] Assignee: Robert Bosch GmbH, Stuttgart, Fed. Rep. of Germany

[21] Appl. No.: 929,304

[22] Filed: Aug. 13, 1992

Related U.S. Application Data

[63] Continuation of Ser. No. 661,851, Feb. 27, 1991, abandoned.

[30] Foreign Application Priority Data

Mar. 28, 1990 [DE] Fed. Rep. of Germany ..... 4009876

[51] Int. Cl.[5] ..... B24D 17/00

[52] U.S. Cl. ..... 51/358; 51/364; 51/365; 51/406

[58] Field of Search ..... 51/358, 364, 365, 394, 51/400, 401, 406, 170 R, 170 PT

[56] References Cited

U.S. PATENT DOCUMENTS

| | | | |
|---|---|---|---|
| 3,703,739 | 11/1972 | Young et al. | 51/406 |
| 4,355,487 | 10/1982 | Maier et al. | 51/170 MT |
| 4,617,767 | 10/1986 | Ali | 51/406 |

*Primary Examiner*—M. Rachuba
*Attorney, Agent, or Firm*—Michael J. Striker

[57] ABSTRACT

A hand held power tool has a working disc and a working sheet held on the working disc by a burdock connection. The working disc has a burdock surface. An intermediate pad is held on the burdock surface of the grinding disc. The intermediate pad has a first side provided with a velour coating and releasably connectable with the burdock surface of the grinding working disc and a second side releasably connectable with the working sheet.

20 Claims, 4 Drawing Sheets

1
7
3
5
9
11
10
16
17
15
19
24
13
22
21
23
25
24
22
21
23
25

HAND HELD POWER TOOL WITH WORKING DISC

This is a continuation of application Ser. No. 661,851, filed Feb. 27, 1991, now abandoned.

BACKGROUND OF THE INVENTION

The present invention relates to a hand held power tool, such as for example an eccentric disc grinder.

Eccentric disc grinders are known in the art. One of such eccentric disc grinders is disclosed for example in the German reference DE-OS 3,625,655. It has a grinding disc for receiving grinding sheets. The grinding disc is a complex structural element which includes a bending-resistant disc fixedly connected with a flat padding disc. This is subsequently indicated as integrated intermediate pad. Such grinding disc are available in three conventional different embodiments. The differences corresponds to the three conventional grinding sheet types: with self-adhesive back, with velour-coated back, with central opening for a clamping screw.

There is also a grinding disc which has both the grinding sheet with the velour back and also the grinding sheet with central opening for the clamping screw. Other grinding discs can receive both the grinding sheet with adhesive back, and also the grinding sheet with central opening for a clamping screw.

All grinding discs have the same disadvantage in that the use of thee conventional types of the grinding sheets on the same grinding disc is not possible. The known grinding discs with integrated intermediate plates must be thrown away after their wear.

SUMMARY OF THE INVENTION

Accordingly, it is an object of the present invention to provide a hand held power tool which avoids the disadvantages of the prior art.

In keeping with these objects and with others which will become apparent hereinafter, one feature of the present invention resides, briefly stated, in that the burbock (bur) surface of the working disc has an intermediate pad releasably on its first side which carries a coating of velour, whereas its second side releasably holds a grinding sheet.

When the hand held power tool especially an eccentric disc grinder is designed in accordance with the present invention, all three grinding sheet types can be exchangeably with the same grinding disc. Instead of integrated intermediate pad, a separate intermediate pad is provided which is exchangeable during wear. The new grinding disc is composed only of a bending-resistant disc with a burdock (bur) surface. Its hardness value can be varied between very hard and very soft within a broad region. The term "burdock surfaces" is used here to identify a well-known hook and loop type (Velcro) fastening connection.

Since the intermediate pad of the grinding disc is thermally insulated from the heat action of the grinding sheet, the service life of the grinding disc is significantly increased with considerable saving that follows.

Moreover, the grinding sheets with adhesive back must not be released from the intermediate pad during the winding sheet exchange, when for example another grinding sheet grain is required. After pulling of the intermediate pad of the grinding disc, together with the respective grinding sheet, it can be removed together with the intermediate pad and used again. The grinding disc can be provided by setting of another intermediate pad with the desired grinding paper.

Previously the grinding sheets with adhesive backs were not used again after their release from the grinding disc since a new mounting on the grinding disc was not possible. The reason was that the adhesive layer used to lose its adhesive property during contact with grinding dust.

In accordance with another feature of the present invention, the second side of the intermediate pad can be provided with a coating with burdock hooks, or with a small adhesive coating such as synthetic leather. The intermediate pad can be formed as bendable disc with a thickness smaller than 1/50 of the disc diameter or as a bending-elastic disc with a thickness greater than 1/50 of the disc diameter.

The intermediate pad can be composed of rubber-like, preferably foam material.

The grinding disc can be formed as a bending-resistant disc of steel, aluminum or synthetic plastic material.

A plurality of intermediate pads which are placed on one another can also be provided in the inventive hand held power tool.

The grinding disc and the intermediate pad can be provided with openings for dust aspiration, arranged on different diameters of partial circles.

The grinding disc can carry elastic fitting pins on free side coated with adhesive surface, and the intermediate pad can be provided with fitting openings. They are positioned so that during insertion of the elastic fitting pins into the fitting openings the recesses for dust aspiration in the grinding disc and the intermediate pad are arranged in alignment with one another.

The fitting pins of the grinding discs can correspond in their positions to certain diameters of the grinding discs and the same is true with respect to the fitting openings of intermediate pads of different diameters. Therefore an intermediate pad of corresponding size can be placed on a respective one of the grinding discs.

The grinding disc and/or the intermediate pad can receive a steel sheet disc extending outwardly beyond the periphery of the grinding disc or the grinding pad.

The steel sheet disc can have a velour back or an adhesive back. The steel sheet disc can carry fitting pins at the side of the velour back or the adhesive back. The fitting pins extend in fitting openings of the grinding disc or the intermediate pad.

The fitting openings for the fitting pins can be formed simultaneously as recesses for dust aspiration.

Finally, the diameter of the steel sheet disc can be greater by 200 mm than the diameter of the intermediate pad or the grinding disc, and the thickness of the steel sheet disc can amount to approximately 0.5 mm.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
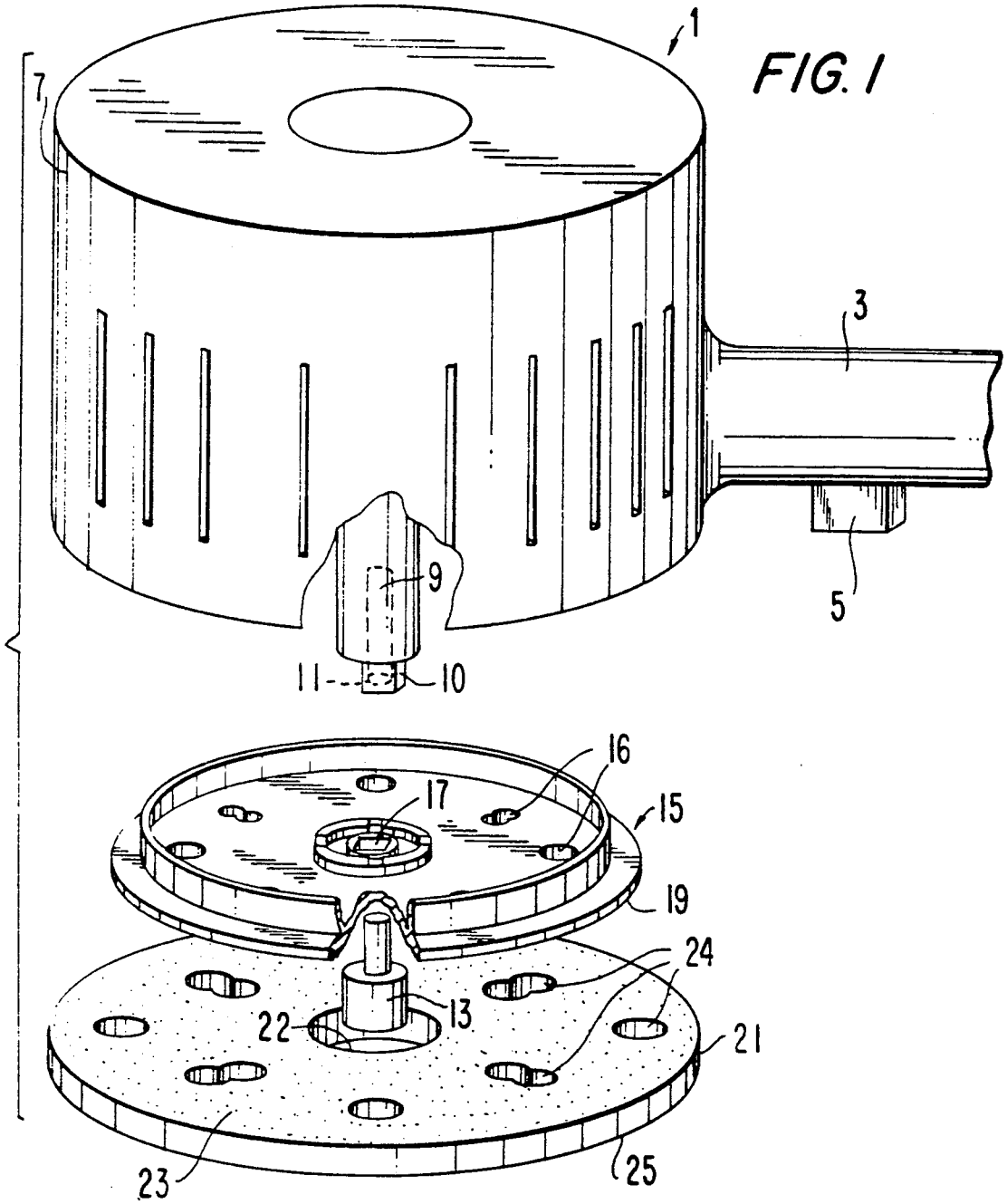
FIG. 1 is a view showing an eccentric disc grinder with a separate intermediate pad in accordance with the present invention.
Figure 7:
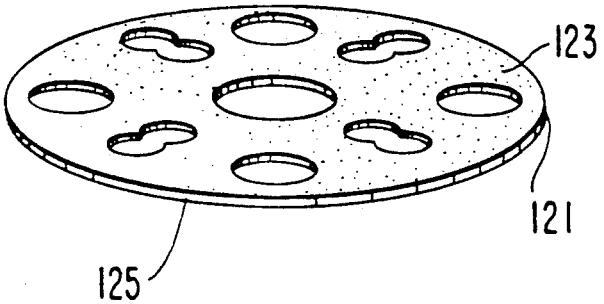
FIG. 7 shows an intermediate pad in accordance with a further embodiment.

A hand held tool is shown in FIG. 1 as an eccentric disc grinder which is identified as a whole with reference numeral 1. It has a handle 3 provided at its upper side and having an on-off switch 5. A housing 7 of the tool has a not shown motor with a drive spindle 9. The spindle 9 carries at its end a square piece 10 provided with a threaded opening 11 for an inner hexagonal screw 13. A grinding disc 15 is arranged on the square piece 10 and have an inner hexagonal screw 13. The grinding disc 15 is provided with a central square opening 17 corresponding to the square piece 10.

The grinding disc is coated at its free side with a burdock surface layer 19. It cooperates with an intermediate pad 21 which on its first side 22 is coated with a velour surface layer. The grinding disc 15 and the intermediate pad 21 are provided with openings 16 and 24 for dust aspiration.

The intermediate pad 21 is provided with a central recess 22 for inserting the head of the hexagonal screw 13 in a contact-free manner. A second side 25 of the intermediate pad 21, located opposite to the first side 23 is provided for receiving of a not shown grinding sheet. The grinding sheet abuts with its back side against the second side 25 and can be fixed with the same by a burdock connection, an adhesive surface, or an additional central holding screw.

Figure 2:
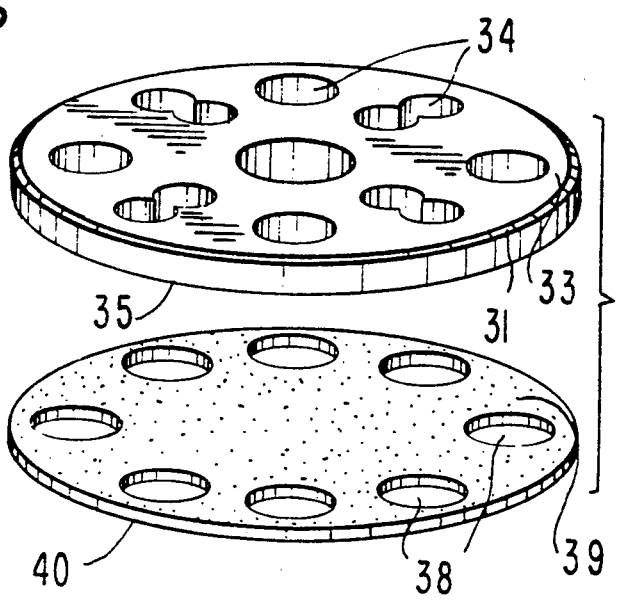
FIG. 2 is a view showing a separate intermediate pad with a grinding sheet having a velour back in accordance with the present invention.

An intermediate pad 31 shown in FIG. 2 is provided with a velour surface layer on its first side 33. Thereby the intermediate pad 31 can be mounted on a not shown grinding disc. On the second side 35, the intermediate pad 31 is provided with a burdock surface layer. A grinding sheet 37 with velour back 39 can be fixed on this surface. The intermediate pad 31 and the grinding sheet 21 are provided with openings 16 and 24 for dust aspiration.

Figure 3:
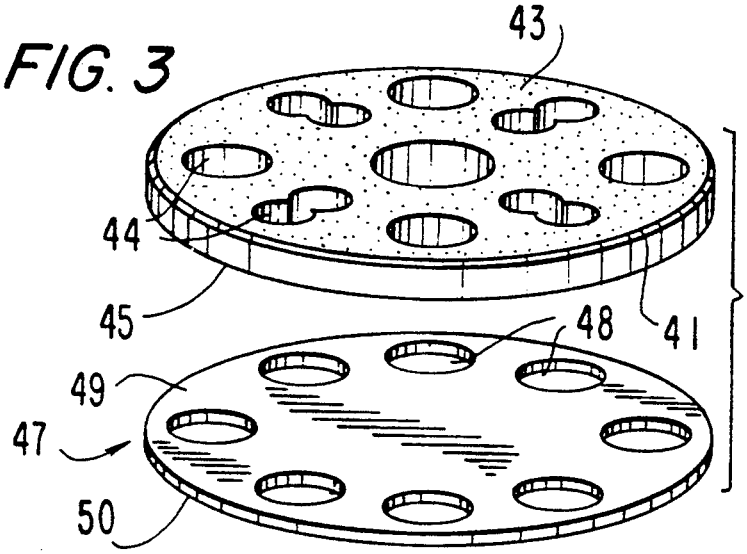
FIG. 3 is a view showing a separate intermediate pad with a grinding sheet having adhesive back.
Figure 6:
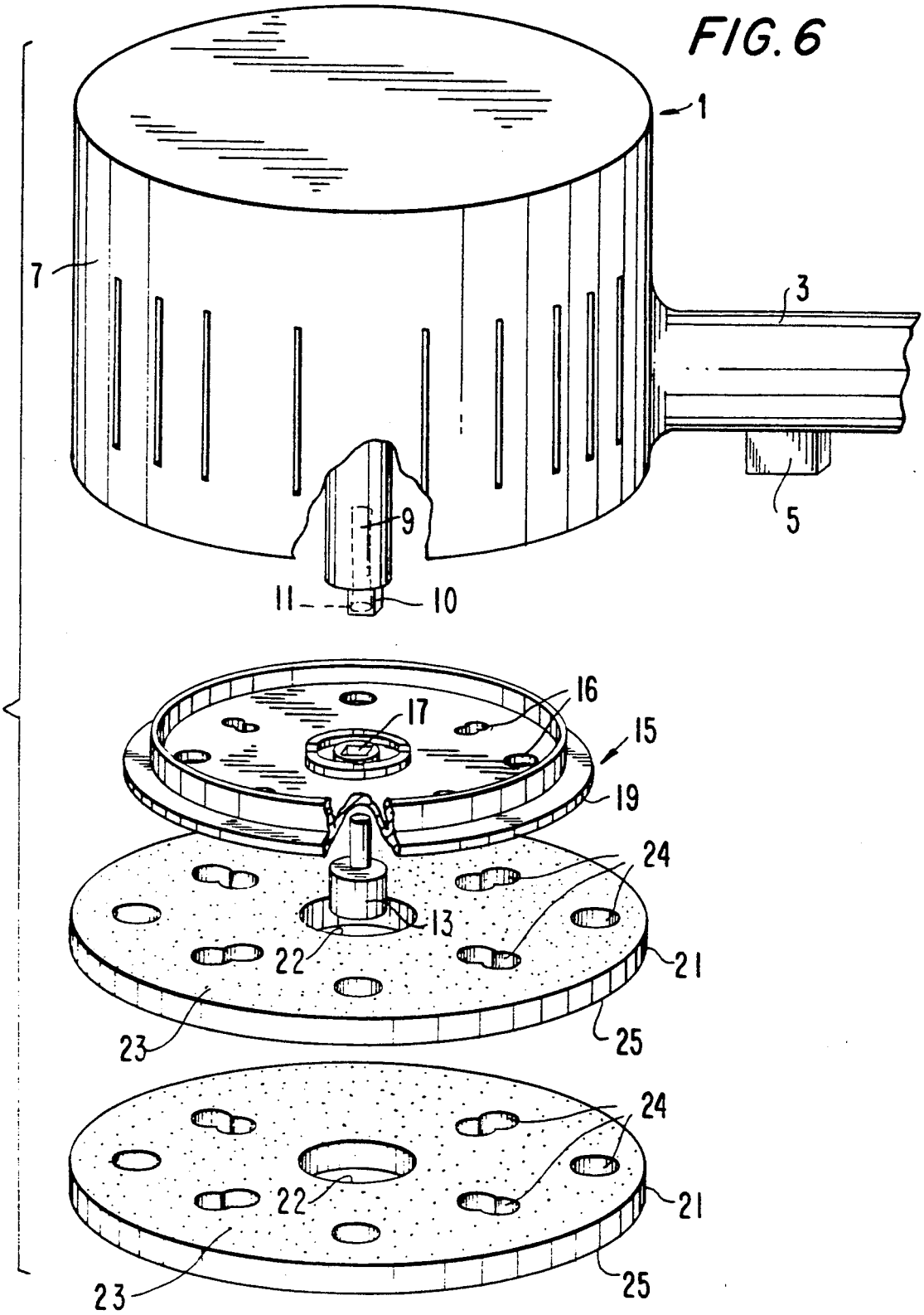
FIG. 6 shows the eccentric disc grinder with a plurality of intermediate pads.

An intermediate pad 41 shown in FIG. 3 is provided with velour on its first side 43 and can be mounted with it on the burdock surface of a not shown grinder disc. The second side 45 of the intermediate pad 41 is provided with a smooth, artificial leather-like layer. A grinding sheet 47 is mounted with its adhesive back 49 on this layer. The intermediate pad 41 and the grinding sheet 47 are provided with openings 44 and 48 for dust aspiration. The eccentric disc grinder can be provided with a plurality of the intermediate pads (21, 31, 41) as shown in FIG. 6.

The mounting of the grinding disc 15, the intermediate pads 21, 31, 41 as well as the grinding sheets 37, 47 on the eccentric disc grinder is performed in the following manner:

First the grinding disc 15 with its square opening 17 is fitted over the square piece 10 of the drive spindle 9. The inner hexagonal screw 13 is screwed into the threaded opening 11, so that the grinding disc 15 is fixed on the drive shaft 9. The intermediate pad 31 is pressed with its first side 21 with the velour coating against the burdock surface 19 and fixed on its, or in other words, held in a non-displaceable and rotary-fixed manner. Depending on whether the second sides 25, 35 is provided with a burdock surface or a smooth, synthetic leather-like surface, the grinding sheets 37, 47 are mountable with the velour back 49 or adhesive back 49.

Directly on the guiding disc 15, a grinding sheet with velour back can be mounted on the burdock surface 19. This corresponds to the greatest hardness value for the grinding sheet holding. With a lower desired hardness value, the intermediate pads 21, 31, or 41 is set on the grinding disc 15 and then a corresponding grinding sheet 37, 47 is fixed on it. When for example a grinding sheet 47 with the adhesive back 49 fixed on the grinding disc 15 by means of the intermediate pad 41 must be replaced by a grinding sheet 37 with the velour back, it must be exchanged together with the intermediate pad 41. For this purpose the intermediate pad 41 together with the grinding sheet 47 sitting on it is pulled from the grinding disc 15 and exchanged for the intermediate pad 31 with the grinding sheet 37 with the velour back 39.

In this manner for the first time an exchange of the grinding sheet 47 with the adhesive back 49 for unimpaired further utilization is possible. Before this, the grinding sheet 47 was directly separated from the intermediate pad 41 and made non-useable. In many cases the grining sheet 47 is torn during loosening or adheres the grinding dust on the free adhesive back, so that no sufficient adhesive action to the intermediate pad 41 can be obtained. In the case of the present invention, the grinding sheet 47 can remain on the intermediate pad 41 and after exchange for different grinding sheet types with associated intermediate pads can be used again.

The intermediate pads 21, 31, 41 can be placed as described also on conventional grinding discs with integrated intermediate pads. In this case an especially low hardness value of the grinding sheet holder is obtained. The inventive intermediate pad is also useable in cooperation with additional devices for drilling with machines or angular grinders, which for receipt of grinding sheets are suitable with velour backs.

A further embodiment of the invention shown in FIG. includes a thin, bendable disc with a material thickness corresponding approximately to 1/50 of the disc diameter. Such an intermediate pad can be formed for example as a synthetic leather disc coated at one side 123 with velour. This is especially suitable for receiving of grinding sheets with adhesive back.

Such a thin intermediate pad which is provided on the synthetic leather layer-side with a burdock coating 125 is advantageous for special applications, for the use of grinding sheets with velour backs.

The arrangement of the openings 16, 24 in the grinding disc 15 and in the intermediate pads 21, 31, 41 on three different diameters over partial circles secured a universal grinding dust aspiration. The recesses 16, 24 correspond to the air passage openings of all known grinding sheets.

Figure 4:
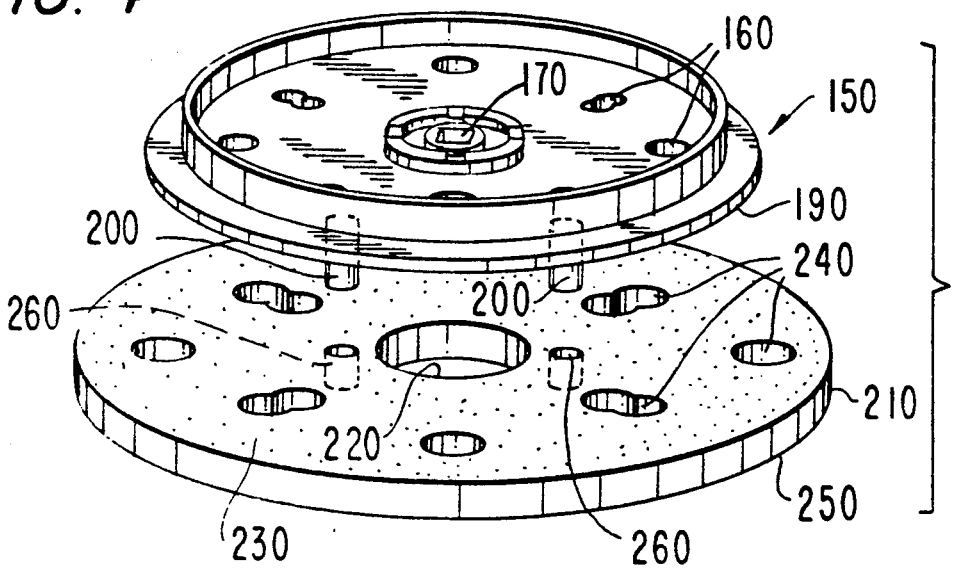
FIGS. 4 and 5 show two further modifications of the eccentric disc grinder in accordance with the present invention.

A grinding disc 150 shown in FIG. 4 has a square opening 170 and is provided at its free side with elastic fitting pins 200. It is also provided with a further burdock layer 190. The burdock surface 190 is associated with an intermediate pad 210 with its first side 230 coated with a velour surface. The grinding disc 150 and the intermediate pad 210 are provided with openings 160, 240 for dust aspiration.

Intermediate pad 210 is provided with a central recess 220 for insertion of the head of not shown inner hexagonal screw in a contact-free manner. The second side 250 of the intermediate pad 210 which is opposite to the first side 230 is provided for receipt of a not shown grinding sheet. The grinding sheet abuts with its rear side against the second side 250 and can be fixed by means of welding connections, adhesive surface or additional, central holding screw. In addition, compare with FIG. 1, the intermediate pad 220 is provided with fitting openings 260 for inserting the elastic fitting pins 200 of the grinding disc 150, so that during plugging the openings 140, 260 are oriented in alignment relative to one another.

Thereby it is prevented that on the grinding disc 150 not permitted, intermediate pad-like parts are mounted or with the grinding disc 150 an intermediate pad with too small or too large diameter can be used. Grinding disc intermediate pads which do not correspond to respective sizes can lead to damages to working surfaces to be processed since for example the danger of releasing the intermediate pads takes place due to too small mounting surface.

Figure 5:
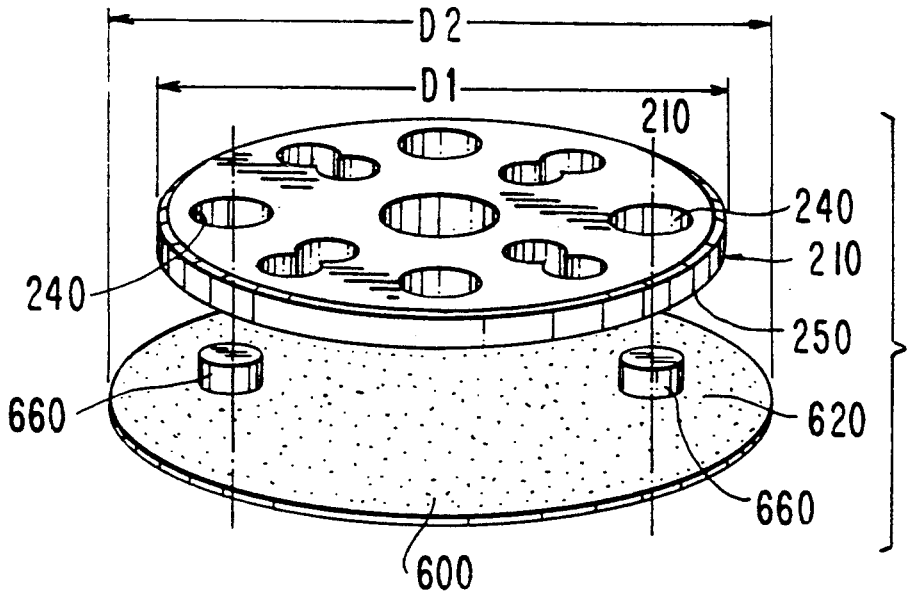

FIG. 5 shows an intermediate pad 150 with openings 240 and a burdock coating 250. A sticky smooth coating can also be arranged instead of the burdock coating 250. The intermediate pad 150 is associated with a steel disc 600 with velour back 620 or with adhesive back in the case when the intermediate pad 150 carries a sticky coating. The steel disc 600 is provided with fitting pins 660. The fitting pins 660 coincide in a mirror-symmetrical manner with two openings 260 of the intermediate pad 150. Therefore during mounting of the steel disc 600 on the intermediate pad by means of the burdock or adhesive connection, the fitting pins 660 are inserted into two associated openings 240.

When erroneous mounting of the steel disc 600 on an intermediate pad with the burdock or adhesive surface, however without openings 240, is prevented in this case by the fitting pins 660 projecting from the intermediate pad 210. Thereby this insures that the steel disc 600 is not mountable on the grinding disc for drilling machines or angular grinders, since due to high working speeds of these machines there are many dangers resulting from the difficulty to control high cutting speed or releasing of the steel disc 600 from the grinding disc.

The steel disc 600 can be placed not only on the intermediate pad 210 but also on the grinding disc 150. The steel disc 600 placed on the grinding disc 150 or on the intermediate pad 210 of an eccentric grinder and fixed both through a burdock or adhesive connection and by the fitting pins 660 is guided with its outer edge in a gap between wall papers or carpet coating and substrate. By rotation and eccentric movement of the steel disc 600, the wall paper or the carpet is peelable from the substrate.

With angular placing, the steel disc 600 is adapted in a springy narrow fashion. Due to the high spring elasticity a blunt insertion on the wall paper joint is possible. Due to the rotary movement of the steel disc 600 its outer edge is self-sharpening during the operation. Due to the long number of revolutions of the grinder disc, the injury danger for operator and the damage danger for example for gypsum substrate is low. The high impact frequency due to the eccentric movement with high eccentricity insures an specially good working results with the steel disc 600 in connection with the eccentric disc grinder. The steel disc 600 can have a diameter which is greater by substantially 200 mm than the diameter of the intermediate pad and/or grinding disc, and can have a thickness of substantially 0.5 mm.

In a not shown embodiment the steel disc is provided with openings for dust aspiration. These openings are arranged in a mirror-symmetrical manner relative to the openings 240, 160.

In a further not shown embodiment, the steel disc is provided with fitting pins which correspond to the recesses for dust aspiration in the grinding disc or with the fitting openings located in the intermediate pad. Thereby the steel disc can operate only with correspondingly provided grinding plates or intermediate pads.

It will be understood that each of the elements described above, or two or more together, may also find a useful application in other types of constructions differing from the types described above.

While the invention has been illustrated and described as embodied in a hand held power tool, especially eccentric disc grinder, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A hand held power tool comprising a working disc; a working sheet held on said working disc by a burdock connection, said working disc having a burdock surface; and an intermediate pad held on said burdock surface of said working disc, said intermediate pad having a first side provided with a velour coating and releasably connectable with said burdock surface of said working working disc and a second side releasably connectable with said working sheet, so that said working sheet is directly arranged on said releasably connectable intermediate pad and indirectly on said working disc and said intermediate pad is non-permanently and interchangeably connectable with said working disc and said working sheet.

2. A hand held power tool as defined in claim 1, wherein said second side of said intermediate pad is provided with a coating with burdock hooks.

3. A hand held power tool as defined in claim 1, wherein said second side of said intermediate pad is provided with a smooth, adhesive coating, said grinding sheet being provided with adhesive back.

4. A hand held power tool as defined in claim 3, wherein said second side of said intermediate pad is provided with a smooth, artificial leather-like layer.

5. A hand held power tool as defined in claim 1, wherein said intermediate pad is formed as a bendable disc with a disc thickness smaller than 1/50 of a disc diameter.

6. A hand held power tool as defined in claim 1, wherein said intermediate pad is formed as a bending-elastic disc with a disc thickness greater than 1/50 of the disc diameter.

7. A hand held power tool as defined in claim 6, wherein said intermediate pad is composed of a rubber-like material.

8. A hand held power tool as defined in claim 7, wherein said rubber-like material is a foam material.

9. A hand held power tool as defined in claim 1, wherein said working disc is formed as a bending-resistant disc composed of a material selected from the group consisting of steel, aluminum and synthetic plastic material.

10. A hand held power tool as defined in claim 1; and further comprising a second such intermediate pad arranged on said first mentioned intermediate pad.

11. A hand held power tool as defined in claim 1, wherein said working plate and said intermediate pad are provided with recesses which are formed for dust aspiration and arranged on different diameters.

12. A hand held power tool as defined in claim 1; and further comprising a steel sheet disc connectable with said working disc and extending outwardly beyond a periphery of said working disc.

13. A hand held power tool as defined in claim 1, and further comprising a steel sheet connectable with said intermediate pad and extending outwardly beyond a periphery of said intermediate pad.

14. A hand held power tool as defined in claim 13, wherein said steel sheet disc has a velour back.

15. A hand held power tool as defined in claim 13, wherein said steel sheet disc has an adhesive back.

16. A hand held power tool as defined in claim 13, wherein said steel sheet disc has a diameter which is greater by substantially 200 mm than a diameter of said one of said intermediate pad and said grinding disc, said steel sheet disc having a thickness of substantially 0.5 mm.

17. A hand held power tool comprising a working disc; a working sheet held on said working disc by a burdock connection, said working disc having a burdock surface; and an intermediate pad held on said burdock surface of said working disc, said intermediate pad having a first side provided with a velour coating and releasably connectable with said burdock surface of said working disc and a second side releasably connectable with said working sheet, so that said working sheet is directly arranged on said releasably connectable intermediate pad and indirectly on said working disc, said working disc having a plurality of elastic fitting pins, said intermediate pad having associated fitted openings.

18. A hand held power tool comprising a working disc; a working sheet held on said working disc by a burdock connection, said working disc having a burdock surface; and an intermediate pad held on said burdock surface of said working disc, said intermediate pad having a first side provided with a velour coating and releasably connectable with said burdock surface of said working disc and a second side releasably connectable with said working sheet, so that said working sheet is directly arranged on said releasably connectable intermediate pad and indirectly on said working disc, said one of said working disc and said intermediate pad having fitting openings, said steel sheet disc having fitting pins arranged at a back side of said steel sheet disc and passing in said fitting opening.

19. A hand held power tool as defined in claim 18, wherein said fitting openings for said fitting pins are formed as openings for dust aspiration.

20. A hand held power tool as defined in claim 17; and further comprising a second such working plate with such fitting pins located at different locations than said fitting pins of said first mentioned working plate; and a second such intermediate pad having a different diameter and provided with fitting openings arranged differently than the fitting openings of the first mentioned intermediate pad, so that by inserting respective ones of said fitting pins in respective ones of said fitting openings only the working disc and the intermediate pad of corresponding diameter can be connected with one another.

* * * * *